US008915360B2

(12) United States Patent
Oliver

(10) Patent No.: US 8,915,360 B2
(45) Date of Patent: Dec. 23, 2014

(54) CASE FOR HOLDING PORTABLE DIGITAL DEVICES

(71) Applicant: Marybeth Oliver, Overland Park, KS (US)

(72) Inventor: Marybeth Oliver, Overland Park, KS (US)

(73) Assignee: Imagine Management, LLC., Overland Park, KS (US)

( * ) Notice: Subject to any disclaimer, the term of this patent is extended or adjusted under 35 U.S.C. 154(b) by 0 days.

(21) Appl. No.: 13/861,193

(22) Filed: Apr. 11, 2013

(65) Prior Publication Data

US 2013/0270126 A1 Oct. 17, 2013

Related U.S. Application Data

(60) Provisional application No. 61/622,888, filed on Apr. 11, 2012.

(51) Int. Cl.

| | |
|---|---|
| ***B65D 85/30*** | (2006.01) |
| ***A45F 5/02*** | (2006.01) |
| ***A45C 15/00*** | (2006.01) |
| *A45C 11/00* | (2006.01) |
| *A45C 13/00* | (2006.01) |

(52) U.S. Cl.

CPC ..... *A45C 15/00* (2013.01); *A45F 5/021* (2013.01); *A45F 2200/0516* (2013.01); *A45C 2011/002* (2013.01); *A45C 13/008* (2013.01); *A45C 11/00* (2013.01); *A45C 2200/10* (2013.01)

USPC ..... 206/320; 206/778

(58) Field of Classification Search

USPC ..... 206/576, 320, 701, 769, 770, 771, 775, 206/776, 777, 778, 782

See application file for complete search history.

(56) References Cited

U.S. PATENT DOCUMENTS

| | | | | |
|---|---|---|---|---|
| 6,006,969 | A | 12/1999 | Kim | |
| 6,772,881 | B2 * | 8/2004 | Le et al. | 206/305 |
| 8,328,055 | B1 | 12/2012 | Snyder | |
| 2002/0175099 | A1 * | 11/2002 | Wu | 206/320 |
| 2004/0251286 | A1 | 12/2004 | Badillo | |
| 2008/0053851 | A1 * | 3/2008 | Ko et al. | 206/320 |
| 2008/0121321 | A1 * | 5/2008 | Tiner et al. | 150/131 |
| 2009/0057357 | A1 | 3/2009 | Rohrbach et al. | |

(Continued)

FOREIGN PATENT DOCUMENTS

WO 2011/115939 A1 9/2011

OTHER PUBLICATIONS

Canvas Cell Phone Case, eCRATER, Website—http://www.ecrater.com/p/15279729/canvas-cell-phone-case.

(Continued)

*Primary Examiner* — Jacob K Ackun

(74) *Attorney, Agent, or Firm* — Kenealy Vaidya LLP

(57) ABSTRACT

A case for holding a portable digital device is disclosed. The case includes a body comprising a first panel and a second panel which are fastened together. The first panel comprises a first pocket to hold the portable digital device, wherein the top cover of the first pocket is made using a transparent material, wherein the first panel flips open to enable a user to operate the portable digital device though the transparent or semi-transparent top cover. The second panel includes a flexible elongated segment to secure the case to an object on which the case is mounted.

17 Claims, 7 Drawing Sheets

(56) References Cited

U.S. PATENT DOCUMENTS

| | | | | |
|---|---|---|---|---|
| 2011/0100847 | A1* | 5/2011 | Ruth | 206/320 |
| 2012/0247989 | A1* | 10/2012 | Cooper | 206/320 |
| 2012/0260611 | A1* | 10/2012 | Jones | 53/468 |
| 2012/0261930 | A1 | 10/2012 | Bethea | |
| 2013/0009413 | A1 | 1/2013 | Chiu, Jr. et al. | |
| 2013/0037187 | A1* | 2/2013 | D'Amore et al. | 150/147 |
| 2013/0043144 | A1 | 2/2013 | McDonald et al. | |

OTHER PUBLICATIONS

Leather Pouch Case Holster for Motorola Droid 3 4 RAZR MAXX Bionic Photon Atrix2, eBay, Website—http://www.ebay.com/itm/Leather-Pouch-Case-Holster-Motorola-Droid-3-4-RAZR-MAXX-Bionic-Photon-Atrix2-/360637186658?pt=US_Cell_Phone_PDA_Cases&hash=item53f7a6c262.

Leather Pouch Holster Case for Motorola Droid 3 4 Bionic Atrix2 Razr Maxx Photon, eBay, Website—http://www.ebay.com/itm/Leather-Pouch-Holster-Case-Motorola-Droid-3-4-Bionic-Atrix2-Razr-Maxx-Photon-/400319307346?pt=US_Cell_Phone_PDA_Cases&hash=item5d34e3de52.

Clip-On, iLoveHandles, 2011, Website—http://ilovehandles.com/products-page/iphone/clip-on.

Hardshell Holster—1 Pack—Retail Packaging—Black, Nite Ize, Website—http://www.niteize.com/product/Hardshell-Holster.asp.

* cited by examiner

CASE FOR HOLDING PORTABLE DIGITAL DEVICES

CROSS REFERENCE TO THE RELATED APPLICATION

This application claims priority under 35 U.S.C. section 119(e) to U.S. Provisional Application No. 61/622,888 filed on Apr. 11, 2012, the entirety of which is incorporated by reference herein.

TECHNICAL FIELD

Embodiments of the present disclosure generally relate to cases for holding portable digital devices and more specifically to cases for holding personal articles including portable digital devices.

BACKGROUND

The use of portable digital devices, including portable media players and smart phones, has dramatically increased in recent years. The portable digital devices have become an integral part of people's daily lives, so much so that many of them wish or are required to take these devices with them wherever they go. However, because these devices vary in size, shape, and weight, it may be difficult or impossible to carry them in certain situations. Users generally encounter this problem when wearing clothing with small, restrictive pockets or clothing without pockets. The problem is exacerbated when the user is performing physical activity, such that it is not practical or comfortable to carry these devices in hands.

Conventionally, many cell phone case pockets are available, where the users willing to access their smart phones have to take out their smart phone from the case pocket which may be attached to the user's belt or waistband. However, the portable digital devices may slip-off from user's hands, especially when they are engaged in a physical activity. Most of the conventional smart phone case pockets available have relatively a common purpose of protecting the smart phone from being dropped. Further, many user carry a cell phone case and a separate bag or folder to carry personal articles such as keys, identification cards or any other such items.

Accordingly, there is a need for an apparatus and method for holding and carrying personal items such as portable digital devices, keys, identification cards, or other such items.

SUMMARY

Embodiments for a case for a portable electronic device are described herein. In an embodiment, the case includes a body including a first panel and a second panel which are fastened together. The first panel includes a first pocket to hold the portable digital device, wherein the top cover of the first pocket is made using a transparent material, wherein the first panel flips open to enable a user to operate the portable digital device though the transparent or semi-transparent top cover. The second panel includes a flexible elongated segment to secure the case to an object on which the case is mounted.

In a further embodiment, the case includes a body including a first panel and a second panel which are fastened together. The first panel includes a front face and a rear face. The front face comprises a first section and a second section opposing a middle section. The first section further includes the first pocket which is formed by joining the edges of the transparent material to the first section, wherein a mesh encircles the first pocket. The transparent material may be a semi-transparent material. A user may plug-in ear-buds to the portable digital device through the mesh. Further, the second section includes a second pocket which is a stretchy pocket that secures tightly over personal item that may fit in the second pocket, wherein the personal items include coins and keys. Moreover, the second section includes a third pocket to secure smart cards.

A more complete understanding of the case will be afforded to those of skill in the art, as well as a realization of additional advantages and objectives thereof, by a consideration of the following detailed description of the preferred embodiment. Reference will be made to the appended sheets of drawings which will first be described briefly.

BRIEF DESCRIPTION OF THE DRAWINGS

The disclosure can be easily understood with reference to the drawings, in which.

DETAILED DESCRIPTION OF ILLUSTRATIVE EMBODIMENTS

In the following description, numerous specific details are set forth to provide a thorough understanding of the present disclosure. However, it will be clear to one skilled in the art that the present disclosure may be practiced without some or all of these specific details. In other instances, well known process steps have not been described in detail in order to avoid unnecessarily obscuring the present disclosure.

Portable Digital Device Case

Figure 1:
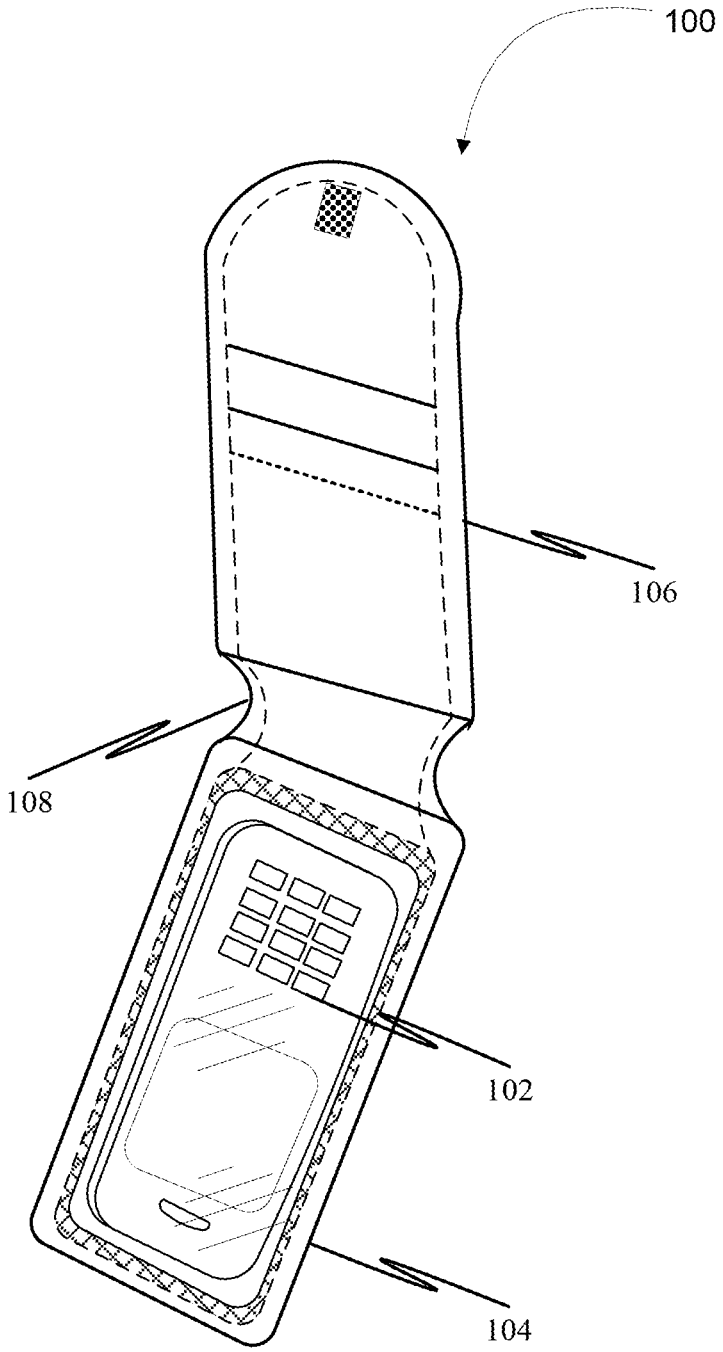
FIG. 1 is a portable digital device case, according to some embodiments of the disclosure.

FIG. 1 is a portable digital device case 100 holding a portable digital device 102, in accordance with some embodiments of the present disclosure. The portable digital device 102 may be a Personal Digital Assistant (PDA), a smart phone, a media player, a digital camera, a tablet computer, USB flash drives etc. The case 100 includes two panels fastened together. The two panels are described in further detail in conjunction with FIG. 2-5 below. FIG. 1 illustrates front face of the first panel, which includes a first section 104 and a second section 106 opposing a middle section 108. The first section 104 holds the portable digital device 102 in an up-side down position, so that it can be easily viewed by the user using the case. This is explained in further detail in conjunction with FIG. 7 below.

The case 100 may be made using nylon pack cloth or other suitable fabric that is breathable, durable, and resistant to easily tearing. Nylon pack cloth is a tough durable nylon fabric that has a polyurethane coating yet it remains flexible. The polyurethane coating also makes the fabric waterproof and abrasion resistant yet lightweight. Further, the body may include foam to protect the portable digital device. Yet further, the body may include a stiff interfacing material to protect the digital device from damage. Moreover, the body may be constructed wholly or in part using a buoyant material. The buoyancy of the case allows the case and contents to float for easy and quick retrieval by the user if the case is dropped in water.

Figure 2:
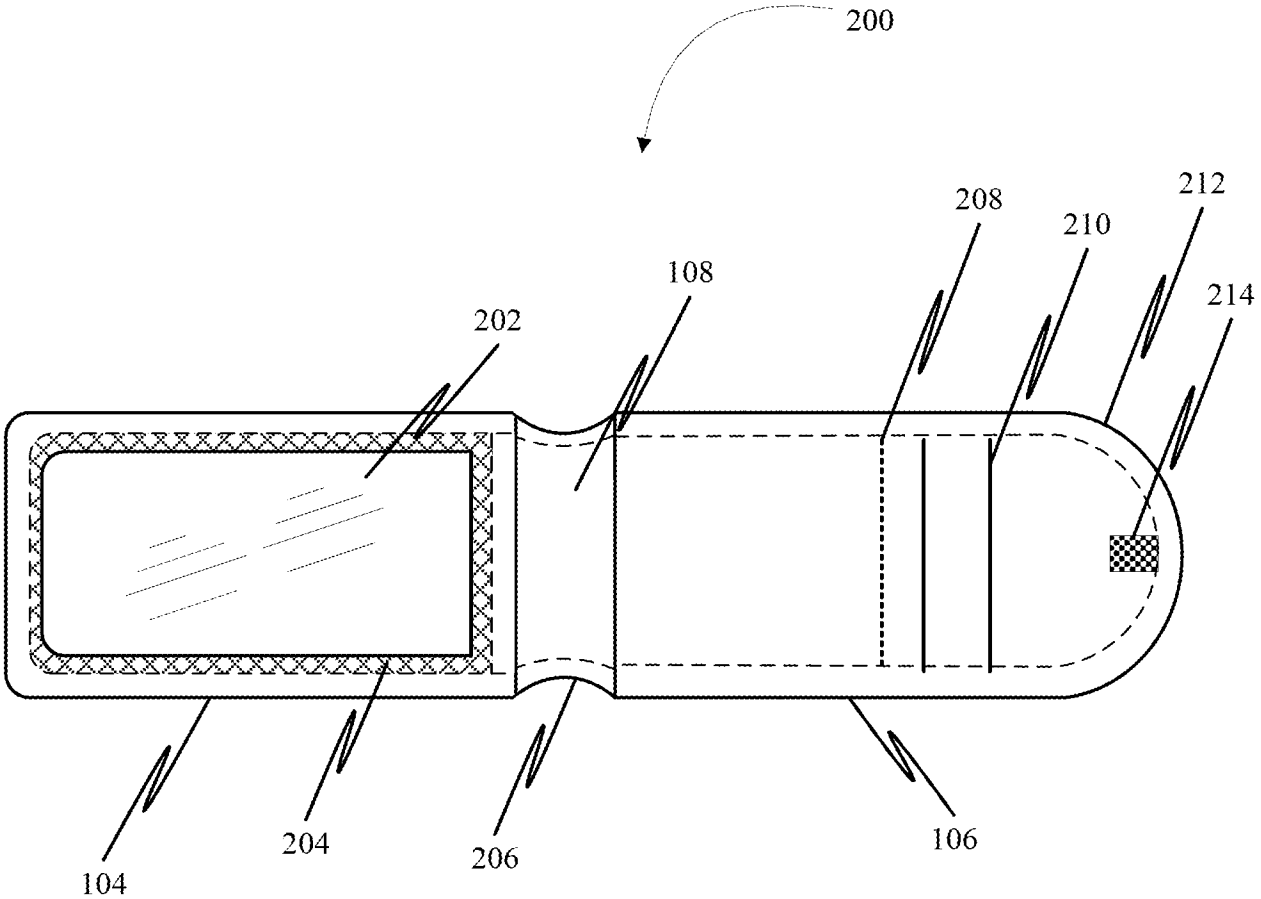
FIG. 2 is a front face of a first panel of the portable digital device case, according to one embodiment of the disclosure.

FIG. 2 shows the front face of the first panel 200. The first panel 200 includes a first pocket 202 on the first section 104. The first pocket 202 is formed by joining a piece of a transparent material with the front panel 200. The edges of the first pocket 202 may be bound with a seam binding. The transparent material may be a clear plastic such as 12 gauge clear vinyl that does not interfere with the touch screen on the portable digital device 102. Further, the transparent material may be a semi-transparent material such as sheer fabric which is made with low density knit. The transparent material may extend across the entire length and width of the first section 104. The transparent material enables a user to easily view and operate the portable digital device 102 while the device is positioned in the first pocket 202 without removing it from the pocket. The transparent material also helps to protect the portable digital device 102 from dirty hands which eventually keeps the portable digital device 102 neat and clean. Also, the case 100 helps portable digital devices slip quickly out of the pocket if user needs it. Moreover, the case 100 helps to keep the portable digital device 102 close and handy to the user and also helps to prevent it from getting lost and theft.

The whole first pocket is encircled with a mesh 204 which helps to dissipate the heat generated by the portable digital device 102. Further, the mesh 204 allows a user to plug-in ear-buds into any of the ends of the portable digital device 102. The case 100 is even more convenient for the Bluetooth™ users. The mesh 204 may be made using a solution died polyester which is also very durable and colorfast. The width of the first pocket 202 may range between approximately 4 to 8 inches. The width may also depend on the width of the portable digital device 102 for which the case 100 is designed. Further, the width of the middle section 108 may range between approximately 1 to 6 inches and the edge of the middle section may form a concave segment 206.

Yet further, the width of the second pocket 208 may range between approximately 3 to 5 inches. The second section 106 includes a second pocket 208 and a third pocket 210. The second pocket 208 is a knit pocket, which may be formed by joining a piece of a nylon fabric with the second section 106. The second pocket 208 may be a stretchy pocket to tightly secure coins, keys, and other personal articles which may fit in it. The third pocket 210 is a slot to secure smart cards including credit cards, gym membership cards, identification cards, etc. The second section 106 also includes a flap 212. When the user is not using the device 102, the user may close the case 100 by pulling up the first section 104 to rest against the second section 106. In this position, the flap 212 goes over the edge to the rear side of the first section 104 and a Velcro element 214 engages with a Velcro element on the rear side of the first section 104 (shown in FIG. 4).

The length of the first panel, which spans the first section 104, the second section 106 and the middle section 108, may range between approximately 10 to 16 inches. At its widest point, the width of the body may range approximately 4 to 7 inches.

Figure 3:
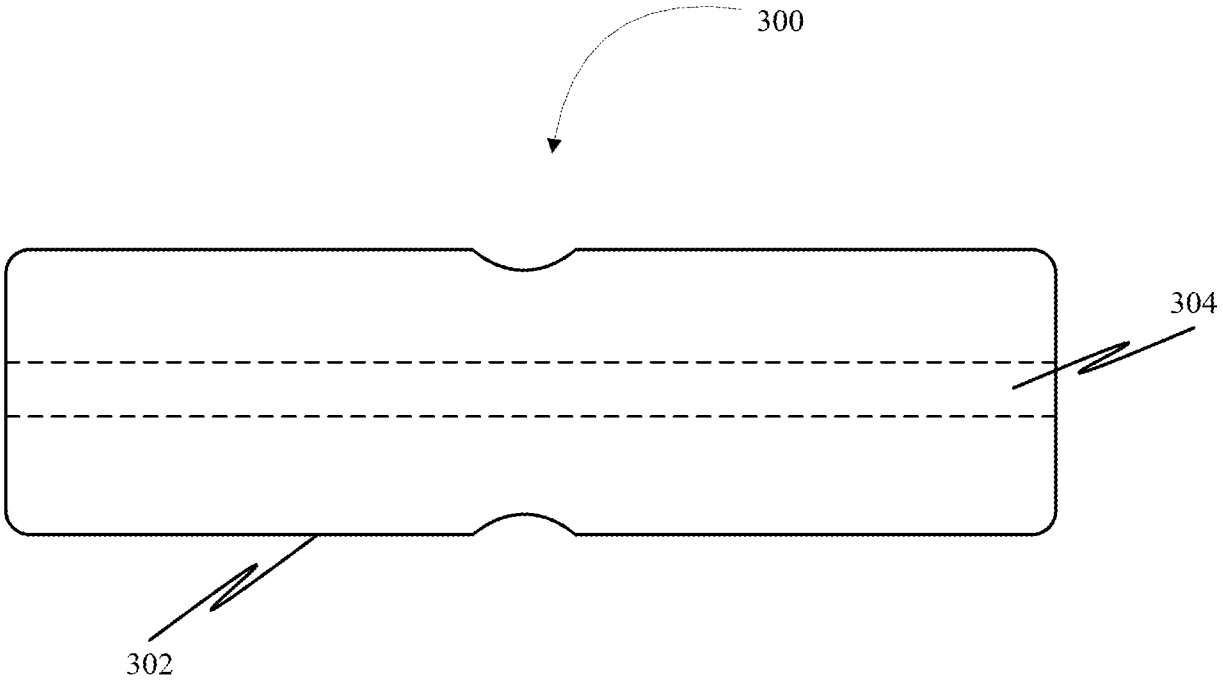
FIG. 3 is a front side of a second panel of the portable digital device case, according to one embodiment of the disclosure.

FIG. 3 is a front side of a second panel 300 of the portable digital device case 100, in accordance with the present disclosure. The second panel 300 is also made up of a material like a nylon pack cloth. Further, a bias binding 302 is located on the edges of the second panel where the front and rear facing portions of fabric are joined together. The front side shows a sewn channel 304 that extends across the entire length of the second panel 300. A metal strapping is inserted into the sewn channel 304 to provide structure to the second panel. For example, the metal strapping may be 0.05 inches wide, 0.017 inches thick and may have a breaking strength of 1275 lbs.

Figure 4:
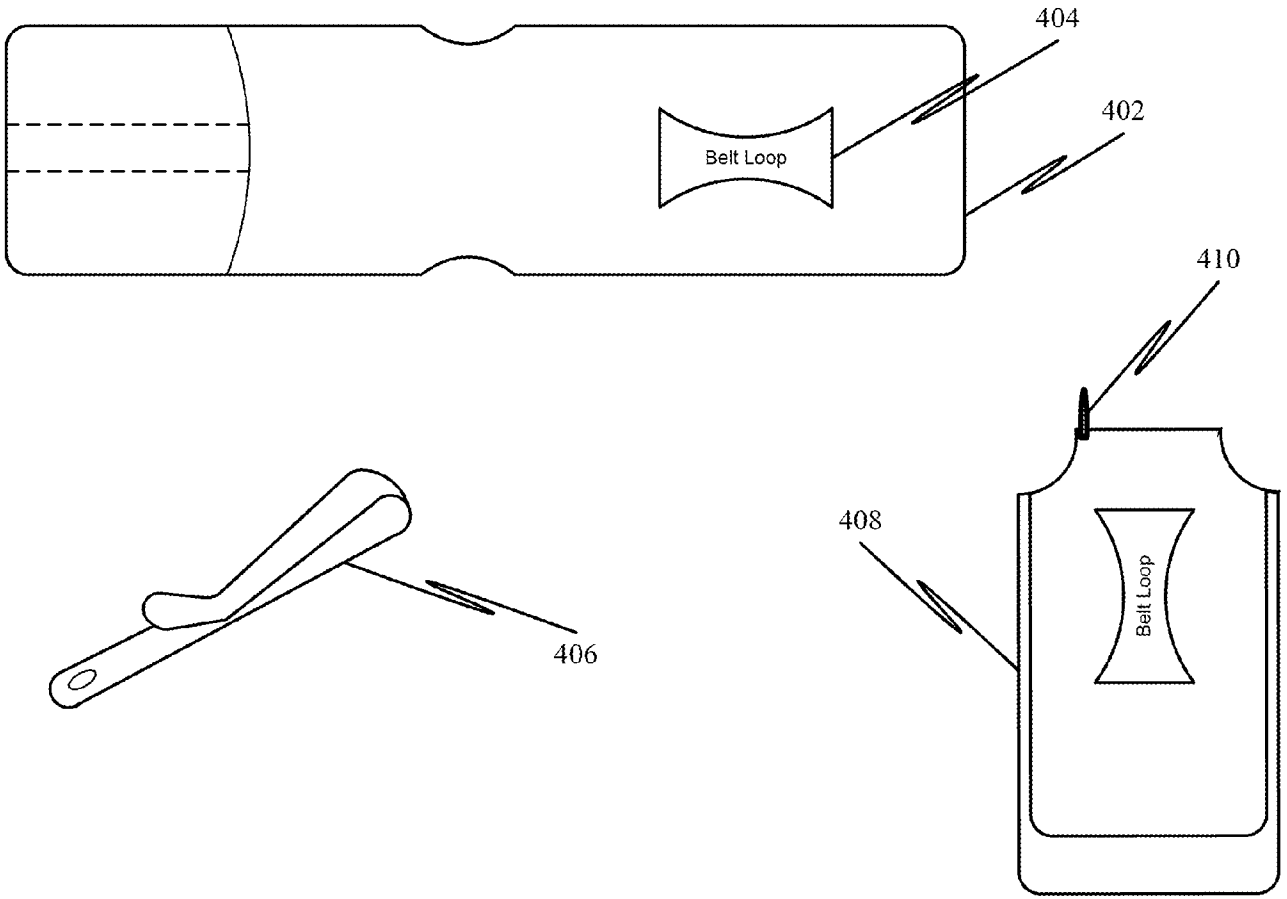
FIG. 4 illustrates the rear side of second panel, according to one embodiment of the disclosure.

FIG. 4 illustrates a rear side 402 of the second panel 300. The rear side 402 includes a belt loop 404 which helps to attach the case 100 over a belt for business wear. Further, FIG. 4 illustrates a flexible elongated segment 406 which may be constructed out of a flexible, shape-holding material, such as flexible wires, strips, or flat springs. The flexible elongated segment 406 may be secured to the interior of the second panel 300 by various means to keep the second panel 300 in bend position 408. In an embodiment, the flexible elongated segment 406 is inserted into the sewn channel 304. The flexible elongated segment 406 maintains the body shape and rigidity of the second panel 30. Further, this flexible elongated segment 406 may be virtually unbreakable and its unique design allows it to be inserted even the second panel 300 is fastened to the first panel 200. The flexible elongated segment 406 helps the case 100 to securely hang on to any waist band. It also helps to slip over the sides of a handbag and eliminates digging through the bag for the portable digital device 102.

Yet further, a D-ring 410 is attached on the edge of the middle section on the rear side of the second panel 300. The D-ring 410 may be metal ring attached to the second panel 300 using a fabric loop that is sewn into the seam of the second panel 300. The fabric loop may be a faille tape. The D-ring 410 may be used to connect different items to the case 100. For example, a user may attach a lanyard, a wristlet, a keychain, etc. to the case 100 to make it easier to carry and/or change the look of the case 100.

Figure 5:
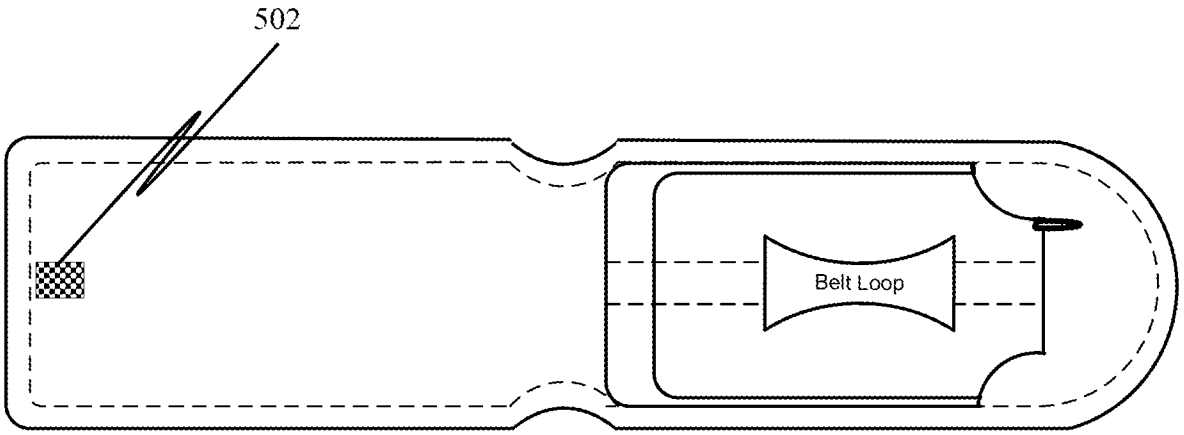
FIG. 5 illustrates a complete case which includes the first panel fastened to the second panel, according to one embodiment of the disclosure.

FIG. 5 shows the complete case 100 which includes the first panel 200 fastened to the second panel 300. The second panel 300 is sewn to the rear side of the first panel behind the second section 106. In an embodiment, the first panel may be fastened to the second panel 300 by sewing it with a fabric material on three edges; thereby, forming a fourth pocket on the fourth edge. The Velcro element 502 engages with the Velcro element 214, when the case 100 is closed.

Figure 6:
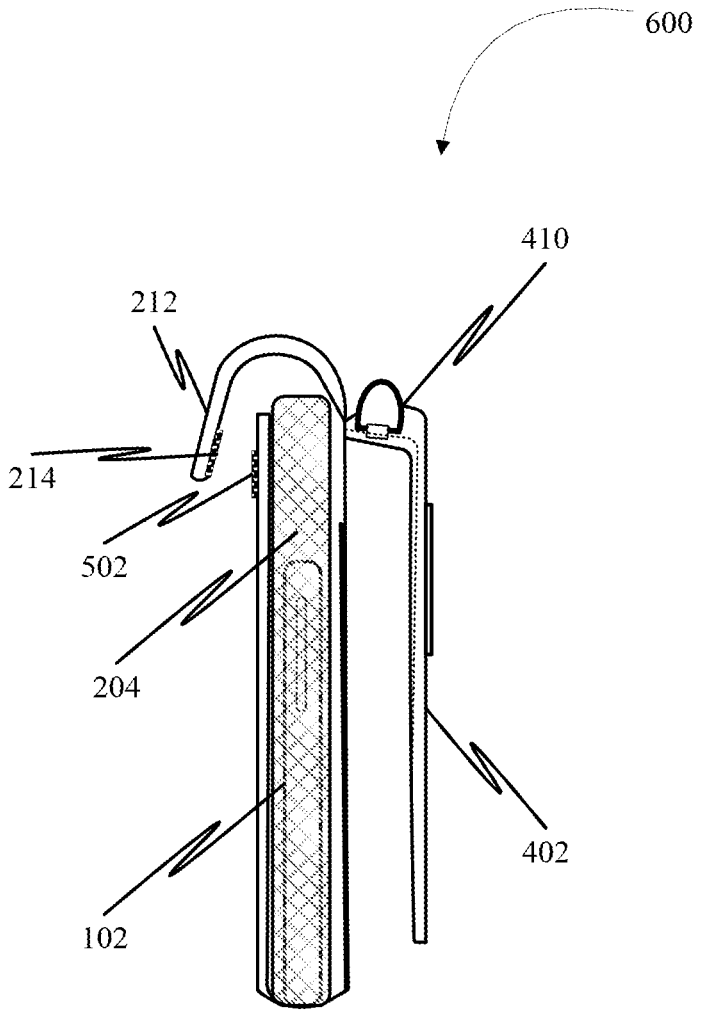
FIG. 6 illustrates a side view of the portable digital device case, according to one embodiment of the disclosure.

FIG. 6 illustrates the side view of the case 100 in closed position. The case 100 containing the portable digital device 102.

Figure 7:
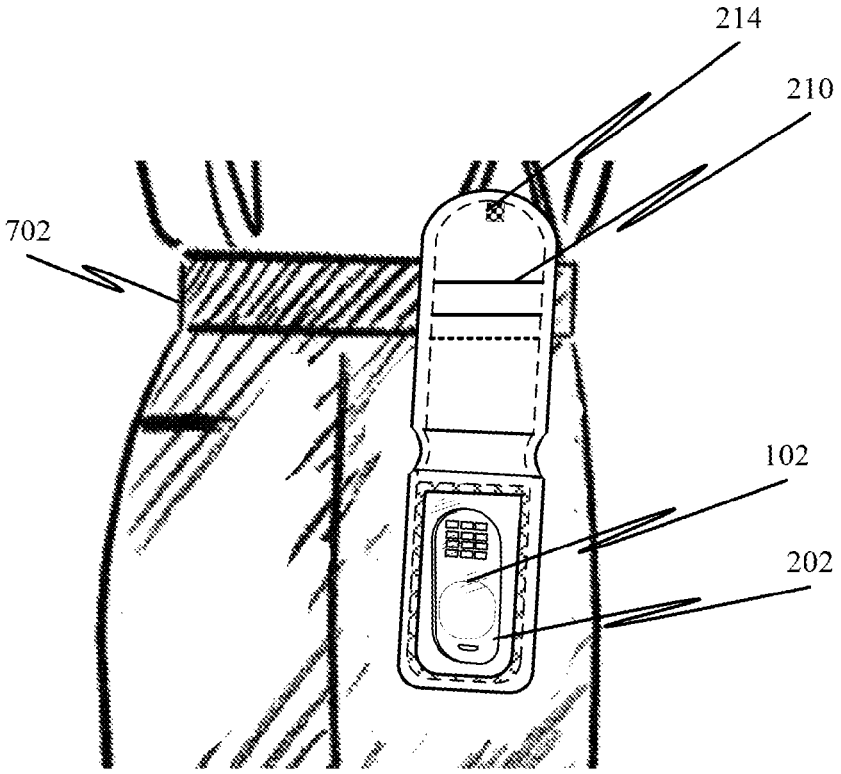
FIG. 7 illustrates the case hanging from the waistband of a user, according to one embodiment of the disclosure.

FIG. 7 shows that the case 100 mounted over a user's waistband 702. The flexible elongated segment 406 in the second panel 300 is pinched around the waistband 702, thereby securing the case 100 to the waistband 702. Also, the portion of the second panel 300 that is tucked into the waistband 702 is of sufficient length and has sufficient rigidity to provide stability to the portable digital device 102. For example, to keep the portable digital device 102 from bouncing while the user runs or exercises. The FIG. 7 also illustrates the second pocket 208, the third pocket 210 and the Velcro element 214. Thus, the first pocket 202 hangs out of the user's waistband 702 but remains securely positioned alongside the user's leg. With such a placement, the user is able to manually grasp and pull up the first pocket 202 to a horizontal position so to view or to manipulate the device 102 through the transparent top cover of the first pocket 202, without removing the device from the first pocket 202. Further, the user may slide the case 100 to the side of the waist when driving or towards the back when cycling.

Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as embodiments. Elements and materials may be substituted for those illustrated and described herein, parts and processes may be reversed, and certain features of the invention may be utilized independently, all as would be apparent to one skilled in the art after having the benefit of this description of the invention. Methods may be implemented manually, in software, in hardware, or a combination thereof. The order of any method may be changed, and various elements may be added, reordered, combined, omitted, modified, etc. Changes may be made in the elements described herein without departing from the spirit and scope of the invention as described in the following claims.

The invention claimed is:

1. A case for holding a portable digital device, the case comprising:

a body comprising a first panel and a second panel which are fastened together;

the first panel comprising a first pocket to hold the portable digital device, wherein the first pocket has a transparent top cover, wherein the first panel flips open to enable a user to operate the portable digital device though the transparent top cover, and the second panel comprising a flexible elongated segment to secure the case to an object on which the case is mounted, wherein the first panel includes a front face having a first section and a second section, and wherein the first section includes a first pocket that is encircled by a mesh.

2. The case according to claim 1, wherein the case is configured to receive the portable digital device in one of a plurality of orientations.

3. The case according to claim 1, wherein the first section and the second section oppose a middle section.

4. The case according to claim 3, wherein the first pocket which is formed by joining the edges of a transparent material to the first section.

5. A case according to claim 4 in which the transparent material is a semi-transparent material.

6. The case according to claim 4, wherein the mesh is capable of receiving and passing through a connection to the portable digital device.

7. A case according to claim 1 in which the first panel includes a flap that is used to secure the case in the closed position.

8. The case according to claim 3 in which the second section includes a second pocket which is a stretchy pocket that is configured to be tightly secured over an object in the second pocket.

9. The case according to claim 8, wherein the object includes at least one of coins and keys.

10. A case according to claim 3 in which the second section includes a third pocket to secure smart cards.

11. A case according to claim 1 in which the second panel includes a metal strapping encased in a stitched channel in the second panel.

12. A case according to claim 1 in which the flexible elongated segment is inserted after the first and second panels are fastened.

13. A case according to claim 1 in which a belt loop is attached on the rear side of second panel.

14. A case according to claim 1 in which a D-ring is provided on the second panel, wherein at least one of a wristlet strap and a keychain is attached to the D-ring.

15. A case according to claim 1 in which the body comprises foam to protect the digital device.

16. A case according to claim 1 in which the body comprises a stiff interfacing material to protect the digital device from damage.

17. A case according to claim 1 in which the first panel and the second panel are fastened by sewing on three edges, thereby forming an enclosure between the panels.

* * * * *